US008876363B2

(12) United States Patent
Brunner et al.

(10) Patent No.: US 8,876,363 B2
(45) Date of Patent: Nov. 4, 2014

(54) DEVICE FOR GASSING LIQUIDS

(75) Inventors: Willi Brunner, Wiesendangen (CH); Dan Tannenberg, Trollhattan (SE)

(73) Assignee: United Waters International AG, Zug (CH)

( * ) Notice: Subject to any disclaimer, the term of this patent is extended or adjusted under 35 U.S.C. 154(b) by 979 days.

(21) Appl. No.: 12/921,191

(22) PCT Filed: Feb. 20, 2009

(86) PCT No.: PCT/EP2009/001223

§ 371 (c)(1), (2), (4) Date: Sep. 7, 2010

(87) PCT Pub. No.: WO2009/109299

PCT Pub. Date: Sep. 11, 2009

(65) Prior Publication Data

US 2011/0007599 A1 Jan. 13, 2011

(30) Foreign Application Priority Data

Mar. 5, 2008 (DE) ..... 10 2008 012 725

(51) Int. Cl.

| | |
|---|---|
| ***B01F 3/04*** | (2006.01) |
| ***B01F 13/02*** | (2006.01) |
| ***B01F 5/00*** | (2006.01) |
| ***B01F 5/04*** | (2006.01) |
| ***B01F 13/10*** | (2006.01) |

(52) U.S. Cl.

CPC ... *B01F 3/04049* (2013.01); *B01F 2003/04872* (2013.01); *B01F 5/0451* (2013.01); *B01F 3/04758* (2013.01); *B01F 13/1016* (2013.01); *B01F 3/0473* (2013.01); *B01F 13/1025* (2013.01)

USPC ..... 366/167.1; 366/174.1

(58) Field of Classification Search

CPC ..... B01F 5/045; B01F 5/08; B01F 5/0405; B01F 5/0413; B01F 5/068; B01F 3/04099; B05B 1/265

USPC ..... 366/174.1, 175.2, 167.1, 182.3, 182.4, 366/181.3, 181.2, 178.1, 178.3, 182.1, 192, 366/163.2

See application file for complete search history.

(56) References Cited

U.S. PATENT DOCUMENTS 724,053 A * 3/1903 Schroder ..... 239/417.3
743,528 A 11/1903 Le Reau (Continued)

FOREIGN PATENT DOCUMENTS

CH 642563 A5 4/1984
DE 1751255 A1 6/1971

(Continued)

OTHER PUBLICATIONS

Office Action mailed Mar. 18, 2013 for corresponding European patent application No. 13154877.8 with partial English translation relating to reference D3 (DE 1751255 A1).

*Primary Examiner* — Tony G Soohoo
(74) *Attorney, Agent, or Firm* — Berenato & White, LLC

(57) ABSTRACT

The invention relates to a method for gassing liquids, in particular for aerating water, wherein gas is fed to a mixing tube (2) via a gas inlet (7) and liquid via a liquid inlet (13) such as to form a mixture of gas and liquid, which is characterised in that the liquid is introduced centrally via a feed pipe (12) and the mouth opening (13) of the latter into the mixing pipe (2) and is spread in the region of the mouth opening (13) by means of an impact onto a spreader (18).

27 Claims, 1 Drawing Sheet

(56) References Cited

U.S. PATENT DOCUMENTS

| | | | | | |
|---|---|---|---|---|---|
| 823,836 | A | * | 6/1906 | Wiemann | 431/186 |
| 1,474,677 | A | * | 11/1923 | Krause | 239/417.3 |
| 1,563,246 | A | * | 11/1925 | Zulver | 239/405 |
| 1,643,967 | A | * | 10/1927 | Tate | 239/417.3 |
| 1,779,647 | A | * | 10/1930 | Brunt | 110/104 R |
| 2,527,689 | A | * | 10/1950 | Robinson et al. | 366/167.1 |
| 2,591,134 | A | * | 4/1952 | Canariis | 210/758 |
| 2,746,711 | A | * | 5/1956 | Kenney et al. | 251/26 |
| 2,908,477 | A | * | 10/1959 | Buri | 251/14 |
| 3,123,127 | A | * | 3/1964 | Willott | 431/186 |
| 3,133,836 | A | * | 5/1964 | Vernon et al. | 127/71 |
| 3,227,425 | A | * | 1/1966 | Stanier | 366/192 |
| 3,347,267 | A | * | 10/1967 | Byron | 366/182.4 |
| 3,547,409 | A | * | 12/1970 | Jacuzzi | 366/160.1 |
| 3,677,522 | A | * | 7/1972 | Hargash | 366/178.1 |
| 3,721,387 | A | * | 3/1973 | Wilmot, Jr. | 239/416.4 |
| 3,770,208 | A | * | 11/1973 | Mueller | 239/417.3 |
| 3,782,884 | A | * | 1/1974 | Shumaker | 431/186 |
| 3,845,904 | A | * | 11/1974 | Mocarski | 239/410 |
| 3,988,002 | A | * | 10/1976 | Kahoun | 251/282 |
| 4,282,172 | A | | 8/1981 | McKnight | |
| 4,375,185 | A | | 3/1983 | Mencacci | |
| 4,443,182 | A | * | 4/1984 | Wojcieson et al. | 431/183 |
| 4,631,004 | A | * | 12/1986 | Mock | 417/189 |
| 5,292,244 | A | * | 3/1994 | Xiong | 431/189 |
| 5,372,283 | A | * | 12/1994 | Schmitkons et al. | 222/145.6 |
| 5,622,655 | A | * | 4/1997 | Cincotta et al. | 261/76 |
| 5,992,529 | A | * | 11/1999 | Williams | 169/14 |
| 6,203,186 | B1 | * | 3/2001 | Cruz | 366/163.2 |
| 6,701,715 | B2 | * | 3/2004 | Anderson et al. | 60/782 |
| 2004/0246813 | A1 | * | 12/2004 | Lang | 366/162.4 |

FOREIGN PATENT DOCUMENTS

| | | | |
|---|---|---|---|
| DE | 19707165 | A1 | 8/1998 |
| EP | 0486933 | A2 | 5/1992 |

* cited by examiner

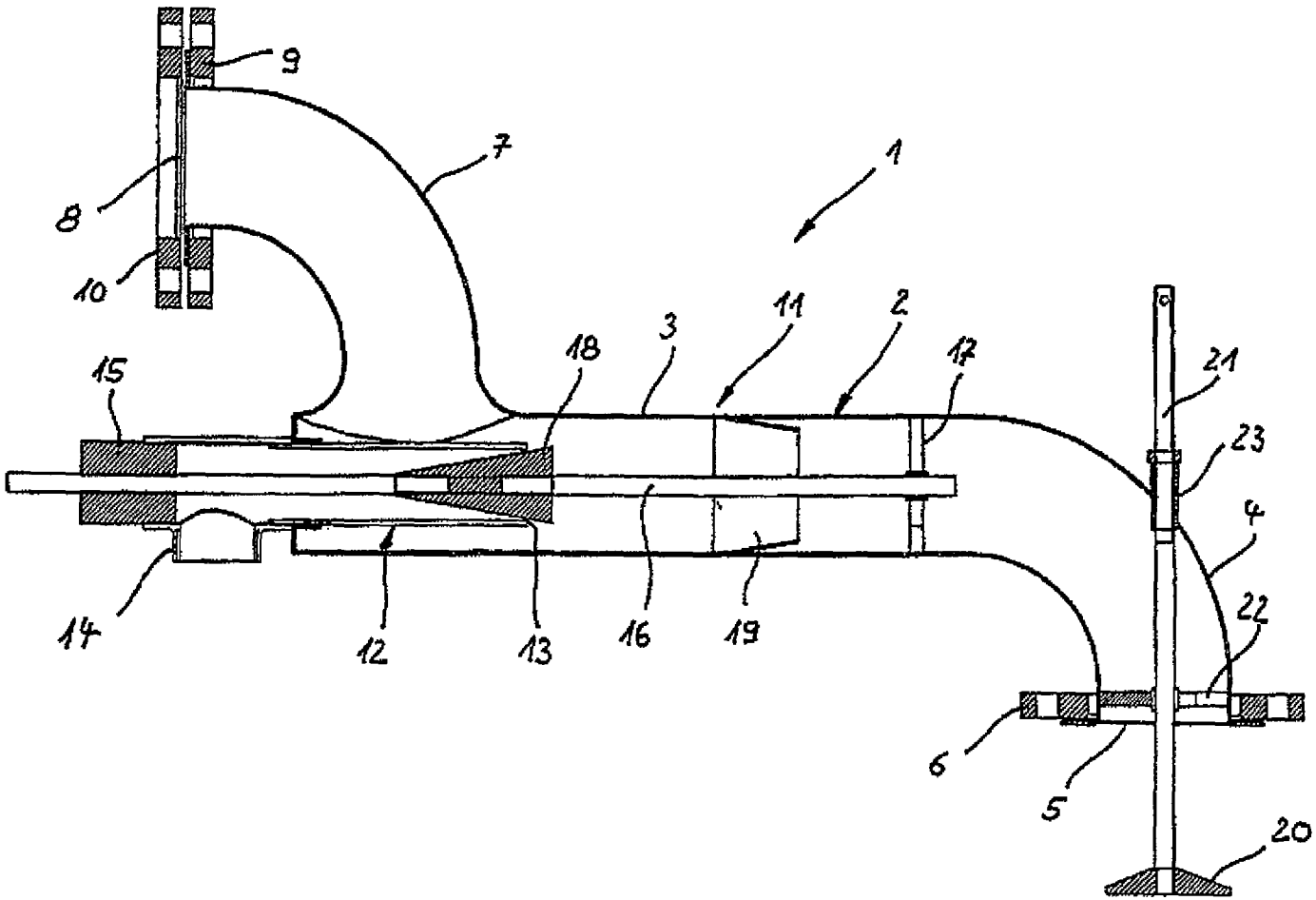
1
2
3
4
5
6
7
8
9
10
11
12
13
14
15
16
17
18
19
20
21
22
23

DEVICE FOR GASSING LIQUIDS

CROSS-REFERENCE TO RELATED APPLICATIONS AND CLAIM TO PRIORITY

This application is a National Phase of International Application No. PCT/EP2009/001223filed Feb. 20, 2009 and relates to German Patent Application No. 102008012725.6 filed Mar. 5, 2008, of which the disclosures are incorporated herein by reference and to which priority is claimed.

The invention relates to a method for gassing liquids, in particular for aerating water, wherein gas is fed to a mixing tube via a gas inlet and liquid via a liquid inlet such as to form a mixture of gas and liquid. Furthermore, the invention relates to an apparatus for implementing the method.

For various purposes it is necessary to provide or enrich a liquid with a gas. Particularly frequently water, in particular bodies of water, is/are aerated in order to increase the oxygen content of the water, and so to improve the living conditions for plants and/or fish or to prevent pollution of the body of water.

For the aerobic treatment of sludge a method is known from CH 642 563 A5 wherein sludge is introduced via a bent pipe nozzle and via a conical valve into a mixing tube. The conical valve has a valve body which is displaceably guided between a closed position and an open position located downstream. Passing through the valve body is a straight air feed pipe which at the same time performs the function of a valve rod and is guided with axial displacement together with the valve body. In the open position of the valve body and when sludge is being fed in, air is sucked in via the air feed pipe which passes centrally into the mixing tube. It is a disadvantage of this method that the mixing of the sludge and air is very uneven over the cross-section.

In addition, hydrodynamic cavitation mixers for producing liquid systems, in particular of emulsions, suspensions or similar, are known wherein by means of special designs within a mixing tube cavitation zones are produced in which coordinated bursting of cavitation bubbles in the local area is produced while at the same time forming pressure waves with high energy. Examples of this can be found in DE 44 33 744 A1 and DE 10 2005 037 026 A1. With both cavitation mixers—as also with the apparatus according to CH 642 563 A5—air is fed centrally into a mixing tube, once with the flow of liquid (DE 44 33 744 A1) and once against the flow of liquid (DE 10 2005 037 026 A1). Here, with the cavitation mixer according to DE 44 33 744 A1 a conical body is inserted into the mouth opening of the central air feed pipe.

The object forming the basis of the invention is to provide a method with which substantially greater enrichment of liquid with a gas, in particular with air, which is more even over the cross-section, is achieved. A further object is to design an apparatus suitable for implementing the method.

The object as regards the method is achieved according to the invention in that the liquid is introduced centrally via a feed pipe and the mouth opening of the latter into the mixing tube, and is spread in the region of the mouth opening by means of an impact onto a spreader. Therefore, the basic idea behind the invention is not to introduce the gas, i.e. generally air, centrally into the mixing tube, but rather the liquid to be gassed, and not simply to allow the latter to flow out into the mixing tube, but rather to spread the latter as it passes out of the mouth opening of the feed pipe. In this way a large surface spread over the cross-sectional area of the mixing tube is produced for the mixing of liquid and gas, as the liquid flows out, gas also being sucked in. Tests have shown that in this way a liquid/gas ratio of more than 1:5 can be achieved, a ratio which is far greater than with known methods.

In order to achieve even spreading of the liquid, one should use a spreader which is formed in an axially symmetrical manner about an axis centric to the central axis of the mouth opening. In this way a spread, especially annular jet of liquid is produced with a large surface for the mixing of liquid and gas. It is advantageous here for the spreading if the cross-section of the spreader increases in the direction of flow. Particularly suitable for the spreading is the shape of a conical body, it also being possible for the surface line to be spherically concave and so approximately in the shape of a mushroom. In particular with a rectangular or square feed pipe one can also, however, consider using a ponton body as a spreader.

Provision is further made according to the invention such that a spreader is used which projects at least partially out of the mouth opening and into the mixing tube because one can then achieve a particularly large spreading effect. Here the largest cross-section of the spreader should be greater than the opening cross-section of the mouth opening.

According to the invention provision is further made such that the flow-through cross-section for the mixture narrows downstream of the mouth opening of the feed pipe. The cross-sectional narrowing can be in the form of a conical aperture with a cross-section narrowing in the downstream direction. After the aperture the mixing tube has its original cross-section once again so that after accelerating the flow through the aperture a type of diffuser effect is produced.

According to a further feature of the invention it is proposed that the mixture impacts upon a displacer which is assigned to the outlet opening at an outlet opening of the mixing tube. In this way a type of sprinkling effect is triggered which leads to optimal surface distribution of the outflowing water/gas mixture and once again to intensive mixing. Preferably a displacer should be used which is formed in an axially symmetrical manner about an axis centric to the central axis of the outlet opening in order to achieve even distribution. Here the diameter of the displacer should increase in the outlet direction. The displacer can, for example, be in the form of a baffle plate and/or a conical body with a straight or spherically bent surface line or of a ponton body.

According to the invention it is further proposed that the mixture impacts upon a displacer disposed outside of the mixing tube. The largest cross-section of the displacer is preferably greater than the free cross-section of the outlet opening.

Finally, provision is made according to the invention such that the mixture in the mixing tube is deflected in the region of the outlet opening over a bend section of the mixing tube. This facilitates moving out of the positioning rod for the displacer.

The second part of the object as regards the apparatus is achieved according to the invention in that the feed pipe is connected or connectable to a pressurised liquid source, there being disposed in the mouth opening a spreader which brings about spreading of the liquid. With the aid of this apparatus the advantages described in connection with the method according to the invention are achieved, in particular the intensive and even mixing and aeration of the liquid with the gas.

The mouth opening and the spreader advantageously have complementary valve bearing surfaces so that the spreader can also be used at the same time as a valve body for closing the mouth opening. For this purpose the spreader should be moved with axial displacement towards the central axis of the feed pipe in order to adjust the gap between the mouth opening and the spreader, and in this way, for example, to be able to adapt to different pressures of the liquid.

According to a further feature of the invention provision is made such that the spreader is coupled to an adjusting device by means of which it can be axially displaced from the outside. The adjusting device can have an adjusting rod on which the spreader sits and which leads out of the feed pipe. In order to guarantee good guidance of the adjusting rod, it should be guided on the one hand in a wall of the feed pipe, and on the other hand in a mounting in the mixing tube. The adjusting rod can be displaced by means of a hand wheel or other manipulatable devices, but also by means of an electrical servomotor.

The mouth opening of the feed pipe should be positioned such that it lies in a straight section of the mixing tube. For feeding the gas an arched feed section directed towards the feed pipe and which ends in the gas inlet opening should be assigned to the mixing tube.

The outlet opening of the mixing tube and the displacer assigned to it should be provided with complementary valve bearing surfaces so that the displacer can be used as a valve body for closing the mixing tube. For this purpose it is advantageous if the displacer is moved with axial displacement towards the central axis of the outlet opening.

According to the invention provision is further made such that the displacer is coupled to a positioning device by means of which it can be displaced axially from the outside. The positioning device can have a positioning rod on which the displacer sits, and which is guided out of the mixing tube. In order to mount the adjusting rod it should on the one hand be guided in a wall of the mixing tube and on the other hand in the mixing tube in the region of the outlet opening. The positioning rod can then be adjusted manually, for example by means of a hand wheel or similar, but also by means of a positioning motor coupled to the positioning rod.

In the drawing the apparatus according to the invention is illustrated in greater detail by means of an exemplary embodiment. It shows the apparatus 1 for aerating water in a longitudinal section.

The apparatus 1 has a mixing tube 2 with a straight section 3 and a bent section 4 adjoining the latter in the direction of flow and which ends in an outlet opening 5. The outlet opening 5 is surrounded by a flange 6 by means of which the outlet opening 5 can be connected, for example, to the opening of a tank.

An arch-shaped air feed section 7, which has on its free end an air inlet opening 8 which is surrounded by a flange 9, opens out on the upstream end of the mixing tube 2. The flange 9 is assigned to a counter-flange 10. Both flanges 9, 10 can be screwed onto one another. The air feed section 7 and the mixing tube 2 with the straight section 3 and the bent section 4 form the main pipe 11 of the apparatus 1.

Projecting into the upstream end of the mixing tube 2 is a straight feed pipe 12 which ends in the straight section 3 of the mixing tube 2 downstream of the mouth of the air feed section 7 into the mixing tube 2 in a mouth opening 13. The mixing tube 2 and the feed pipe 12 have an unchanging, circular cross-section. The feed pipe 12 extends coaxially to the longitudinal axis of the straight section 3 of the mixing tube 2. Outside of the mixing tube 2 the feed pipe 12 has a support 14 opening at a right angle, by means of which the feed pipe 12 can be connected to a water feed line which can be provided with a water pump for the build-up of pressure. The end of the feed pipe 12 projecting out of the mixing tube 2 is closed with a seal 15.

The feed pipe 12 and the straight section 3 of the mixing tube 2 pass through an adjusting rod 16 in a position coaxial to both. The adjusting rod 16 is guided with axial displacement on the one end in the seal 15 and on the other end in a mounting star 17. The mounting star 17 is connected to the inside of the mixing tube 2. Outside of the feed pipe 12 an adjusting device (not shown here) is provided by means of which the adjusting rod 16 can be axially displaced, whether by means of a motor or manually.

On the adjusting rod 16 in the region of the mouth opening 13 there sits a conical body 18 the diameter of which increases in the downstream direction. It projects partially out of the feed pipe 12. Depending on the axial position of the adjusting rod 16 and so of the conical body 18 an annular gap of greater or lesser dimensions is produced between the inner edge of the mouth opening 13 and the casing of the conical body 18. The more the conical body 18 is adjusted in the downstream direction, the larger it is.

Disposed between the mouth opening 13 of the feed pipe 12 and the mounting star 17 there is a conical aperture 19 which is connected on the upstream end to the inside of the mixing tube 2 and reduces the cross-section of the mixing tube 2 conically in the downstream direction. Behind the conical aperture 19 the cross-section corresponds once again to that of the mixing tube 2.

Assigned to the outlet opening 5 of the mixing tube 2 is a baffle plate 20 which is formed conically with a diameter increasing in the direction of flow. It is attached to the end of a positioning rod 21 projecting out of the outlet opening 5 which passes through the outlet opening 5 and is guided here in a mounting star 22 with axial displacement and coaxially to the outlet axis of the outlet opening 5. Towards the top the positioning rod 21 passes through the bent section 4 of the mixing tube 2 in a sealing bush 23. At the end projecting out here—as with the adjusting rod 16—a positioning device is provided by means of which the distance between the outlet opening 5 and the baffle plate 20 can be adjusted by axial displacement of the positioning rod 21.

The apparatus 1 shown works during operation as follows. By means of the support 14 pressurised water, optionally generated by a pump, is fed to the feed pipe 12. In the region of the conical body 18 the water is pushed outwardly and passes in the form of a fanned annular jet via the annular gap formed between the mouth opening 13 and the conical body 18 into the mixing tube 2. In this way air is sucked in via the air inlet opening 8 and the air feed section 7 which mixes intensively with the fanned water jet passing out of the feed pipe 12. This is supported by the conical aperture 19 which brings about acceleration of the water/air mixture. The mixture then passes into the bent section 4 of the mixing tube 2 and flows via the outlet opening 5, for example, into a tank. In so doing the mixture impacts upon the baffle plate 20 and in this way is fanned out broadly, by means of which the water is aerated once again.

The invention claimed is:

1. An apparatus (1) for gassing liquids, comprising:

a mixing tube (2) which has an inlet opening (7, 8) and an outlet opening (5);

a feed pipe (12) which projects centrally into the mixing tube (2) and has a mouth opening (13) directed towards the outlet opening (5), wherein the feed pipe (12) is connected or connectable to a pressurised liquid source;

a spreader (18) disposed in the mouth opening (13) which brings about spreading of the liquid; and a displacer (20) disposed at the outlet opening (5) of the mixing tube (2), wherein the displacer (20) is configured to provide surface distribution of a mixture of the liquid and a gas output from the mixing tube (2)

wherein the mixing tube (2) comprises a cross-sectional narrowing (19) downstream of the mouth opening (13) for causing an acceleration of the mixture of the liquid and the gas, and wherein the displacer (20) is guided with axial displacement towards a central axis of the outlet opening (5).

2. The apparatus according to claim 1, wherein the spreader (18) is formed in an axially symmetrical manner about an axis concentric to a central axis of the mouth opening (13).

3. The apparatus according to claim 2, wherein the spreader (18) has a cross section that increases towards the outlet opening (5) of the mixing tube (2).

4. The apparatus according to claim 1, wherein the spreader is in the form of a conical body (18).

5. The apparatus according to claim 1, wherein the spreader (18) projects at least partially out of the mouth opening (13) and into the mixing tube (2).

6. The apparatus according to claim 5, wherein the spreader (18) has a greatest transverse width that is greater than a free cross-section of the mouth opening (13).

7. The apparatus according to claim 6, wherein the mouth opening (13) and the spreader (18) have complementary valve bearing surfaces.

8. The apparatus according to claim 1, wherein the spreader (18) is guided with axial displacement towards a central axis of the feed pipe (12).

9. The apparatus according to claim 8, wherein the spreader (18) is coupled to an adjusting device for axially displacing the spreader (18) towards the central axis of the feed pipe (12).

10. The apparatus according to claim 9, wherein the adjusting device has an adjusting rod (16) on which the spreader (18) sits.

11. The apparatus according to claim 10, wherein the adjusting rod (16) is guided on the one hand in a wall of the feed pipe (12) and on the other hand in a mounting (17) in the mixing tube (2).

12. The apparatus according to claim 10, further comprising a servomotor for axially displacing the adjusting rod (16).

13. The apparatus according to claim 1, wherein the cross-sectional narrowing is in the form of a conical aperture (19) with a cross-section narrowing in the downstream direction.

14. The apparatus according to claim 1, wherein the mouth opening (13) lies in a straight section (3) of the mixing tube (2).

15. The apparatus according to claim 1, further comprising an arched gas feed section (7) directed towards the feed pipe (12) and assigned to the mixing tube (2).

16. The apparatus according to claim 1, wherein the displacer (20) is formed symmetrically about an axis concentric to a central axis of the outlet opening (5).

17. The apparatus according to claim 16, wherein the displacer (20) has a transverse width that increases in the outlet direction.

18. The apparatus according to claim 1, wherein the displacer is in the form of a baffle plate (20).

19. The apparatus according to claim 1, wherein the displacer is in the form of a conical body (20).

20. The apparatus according to claim 1, wherein the displacer (20) sits outside of the mixing tube (2).

21. The apparatus according to claim 1, wherein the greatest transverse width of the displacer (20) is greater than a free cross-section of the outlet opening (5).

22. The apparatus according to claim 21, wherein the outlet opening (5) and the displacer (20) have complementary valve bearing surfaces.

23. The apparatus according to claim 1, further comprising a positioning device coupled to the displacer (20) for axially displacement.

24. The apparatus according to claim 23, wherein the positioning device has a positioning rod (21) on which the displacer (20) sits.

25. The apparatus according to claim 24, wherein the positioning rod (21) is guided on the one hand in a wall of the mixing tube (2) and on the other hand in the mixing tube (2) in the region of the outlet opening (5).

26. The apparatus according to claim 24, wherein the positioning rod (21) is displaceable axially manually or by a positioning motor.

27. The apparatus according to claim 1, wherein the mixing tube (2) has an arched section (4) in the region of the outlet opening (5).

* * * * *